US008627979B2

(12) United States Patent
Thibaut et al.

(10) Patent No.: US 8,627,979 B2
(45) Date of Patent: Jan. 14, 2014

(54) CAN END

(75) Inventors: Michel Thibaut, Lescar (FR); Stephane Candillon, Paris (FR); Rainer Rohr, Dortmund (DE)

(73) Assignee: Rexam Beverage Can Europe Limited, Luton (GB)

( * ) Notice: Subject to any disclaimer, the term of this patent is extended or adjusted under 35 U.S.C. 154(b) by 278 days.

(21) Appl. No.: 12/865,600

(22) PCT Filed: Jan. 30, 2009

(86) PCT No.: PCT/GB2009/000251

§ 371 (c)(1),
(2), (4) Date: Nov. 23, 2010

(87) PCT Pub. No.: WO2009/095672

PCT Pub. Date: Aug. 6, 2009

(65) Prior Publication Data

US 2011/0272406 A1 Nov. 10, 2011

(30) Foreign Application Priority Data

Feb. 2, 2008 (EP) ..... 08001985

(51) Int. Cl.
*B65D 17/34* (2006.01)

(52) U.S. Cl.
USPC ..... 220/269; 220/906; 413/12

(58) Field of Classification Search
USPC ..... 220/269, 906; 413/12, 14
See application file for complete search history.

(56) References Cited

U.S. PATENT DOCUMENTS

| | | | |
|---|---|---|---|
| D218,961 | S | 10/1970 | Kennedy |
| D243,833 | S | 3/1977 | Markert |
| 4,084,721 | A | 4/1978 | Perry |
| 4,465,204 | A | 8/1984 | Kaminski et al. |
| D387,666 | S | 12/1997 | Wise |
| D387,987 | S | 12/1997 | Neiner |
| 5,711,448 | A | 1/1998 | Clarke, III |
| 5,715,964 | A | 2/1998 | Turner et al. |
| 5,875,911 | A | 3/1999 | McEldowney |

(Continued)

FOREIGN PATENT DOCUMENTS

| | | |
|---|---|---|
| DE | 2553835 A1 | 6/1976 |
| DE | 8915716 U1 | 3/1991 |

(Continued)

OTHER PUBLICATIONS

Rexam Beverage Can Europe Limited, International Search Report from PCT/GB2009/000251 mailed Apr. 15, 2009 from the European Patent Office, acting as International Searching Authority.

*Primary Examiner* — Anthony Stashick
*Assistant Examiner* — James N Smalley
(74) *Attorney, Agent, or Firm* — Ungaretti & Harris LLP

(57) ABSTRACT

A can end (10) having an end panel (12), an openable non-removable panel (15) defined by a score line (14) in the end panel (12) and a non-removable tab (13) attached to the end for acting on the openable panel (15) to cause it to pivot out of the plane of the end panel (12) to provide an opening, the opening being generally oblate with its minor axis passing through the tab characterized in that the ratio of the dimension of the opening on its major axis to the dimension of the opening on its minor axis is greater than 1.7 and the opening area is greater than 350 mm2.

15 Claims, 2 Drawing Sheets

(56) References Cited

U.S. PATENT DOCUMENTS

| | | | | |
|---|---|---|---|---|
| D411,107 | S | 6/1999 | Turner et al. | |
| 5,964,366 | A * | 10/1999 | Hurst et al. | 220/269 |
| 6,024,239 | A | 2/2000 | Turner et al. | |
| 6,234,336 | B1 | 5/2001 | Neiner | |
| D448,666 | S | 10/2001 | Fields | |
| 6,330,954 | B1 | 12/2001 | Turner et al. | |
| 2004/0099664 | A1 | 5/2004 | Hartman | |

FOREIGN PATENT DOCUMENTS

| | | | |
|---|---|---|---|
| EP | 0432659 | A1 | 6/1991 |
| WO | 96/37414 | A1 | 11/1996 |
| WO | 97/29960 | A2 | 8/1997 |
| WO | 97/29960 | A3 | 8/1997 |
| WO | 97/30902 | A1 | 8/1997 |
| WO | 0034137 | A1 | 6/2000 |

* cited by examiner

CAN END

This invention relates to can ends of the type which include an openable non-removable panel defined by a score line and an non-removable tab attached to the end for acting on the openable panel to cause it to pivot to provide an opening through which the contents may be poured or drunk.

European Patent 1135300 describes such a can end and seeks to provide a non-removable openable panel, which it describes as a "tear panel" of non-circular form. It defines certain characteristics of this panel and in particular the aspect ratio (major axis:minor axis). It states that this aspect ratio must be between 1.3 and 1.7 and describes any can end having a ratio of above 1.7 as being unacceptable due to flow rate characteristics. The suggestion of the specification is that an aspect ratio of about 1.5 with a reduced opening area of less than 323 $mm^2$ is preferred. The flow characteristics would be expected to be even more problematic for cans with end panels of relatively small diameter i.e. <47 mm.

From one aspect the present invention consists of a can end having an end panel with a diameter less than 47 mm, an openable non-removable panel defined by a score line in the end panel and a non-removable tab attached to the end for acting on the openable panel to cause it to pivot out of the plane of the end panel to provide an opening, the opening being generally oblate with its minor axis passing through the tab characterised in that the ratio of the dimension of the opening on its major axis to the dimension of the opening on its minor axis is greater than 1.7 and the opening area is greater than 350 $mm^2$ and the opening is generally symmetrical about the minor axis.

The Applicants have discovered that, contrary to the teaching of EP1135300, by increasing both the ratio and the opening area one can provide an opening which not only provides suitable flow characteristics, it is particularly desirable to soft drinks, where the user often wants to quench their thirst rather quickly. Particularly surprisingly these are suitable for smaller diameter cans i.e. those with an end panel <47 mm.

The Applicants have further determined that, when, as in most cases, the score line does not extend the whole way around the opening, and thus defines a hinge in the end panel, the hinge width needs to be rather wider than usual in order to resist the increased forces at the hinge arising from the length of the major axis, whilst not being so large that it will resist the tearing of the openable panel at the score line. Specifically they have determined that a hinge width of between 6.5 mm and 7.6 mm in width is appropriate.

The Applicants have also determined the operations of such an openable panel is particularly efficacious, if the various portions of the panel are formed of parts of notional circles. It is particularly desirable for the portion of the score line that passes through the minor axis and is spaced from the tab forms part of a notional circle having a diameter of between 20 mm and 30 mm. This means that the centre of the circle is positioned some distance on the other side of the tab from the openable panel.

Similarly the portions of the score lines that pass through the major axis may form parts of respective notional circles and these preferably have diameters of between 7.6 mm and 7.75 mm.

Although the invention has been defined above it is to be understood it includes any inventive combination of the features set out above or in the following description.

An embodiment of the invention will now be described with reference to drawings, in which.

Figure 1:
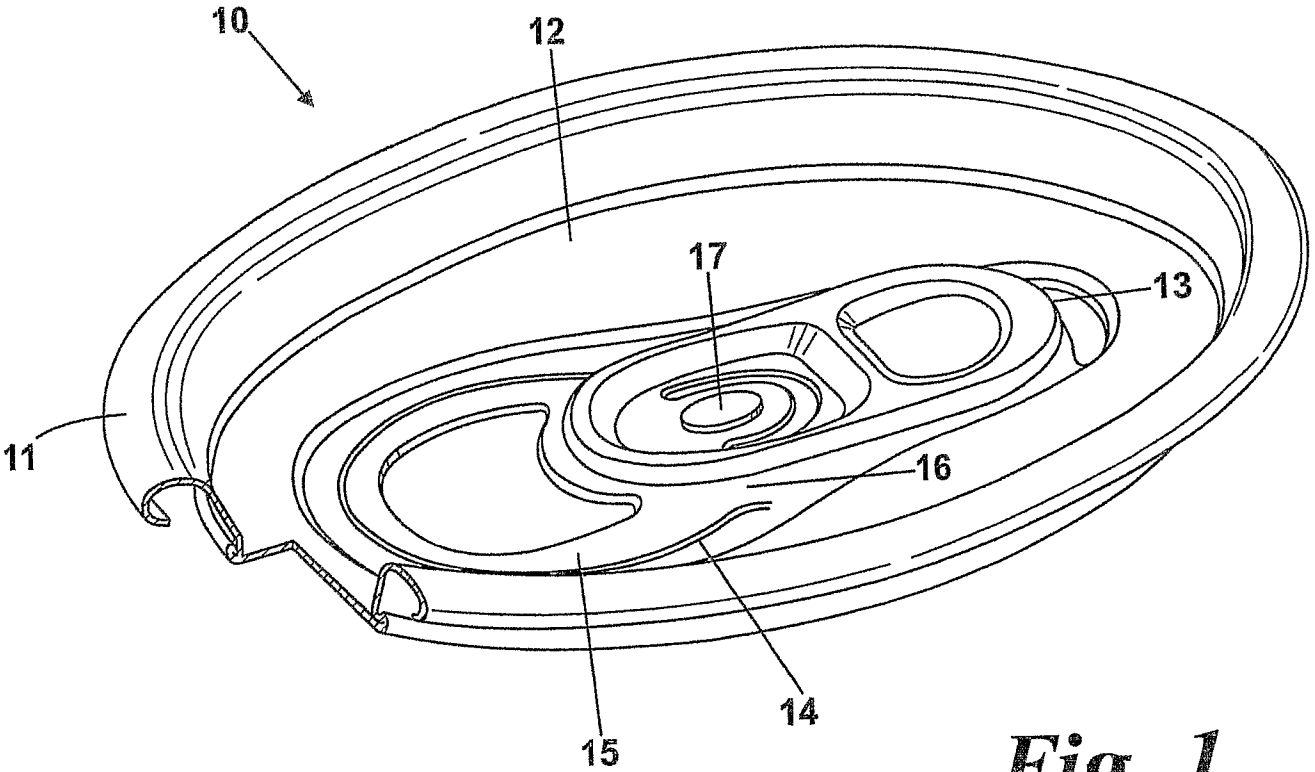
FIG. 1 illustrates an conventional can end.

In FIG. 1 a can end, generally indicated at 10 includes a rim 11, an end panel 12 (with a diameter of less than 47 mm), an opening tab 13 and a score line 14 defining an openable non-removable panel 15. The opening operation using the tab 13 to displace the score panel 15 is well known to persons skilled in the art. A hinge for retaining the panel 15 on the end panel 12, whilst allowing inward pivoting, is indicated at 16.

Figure 2:
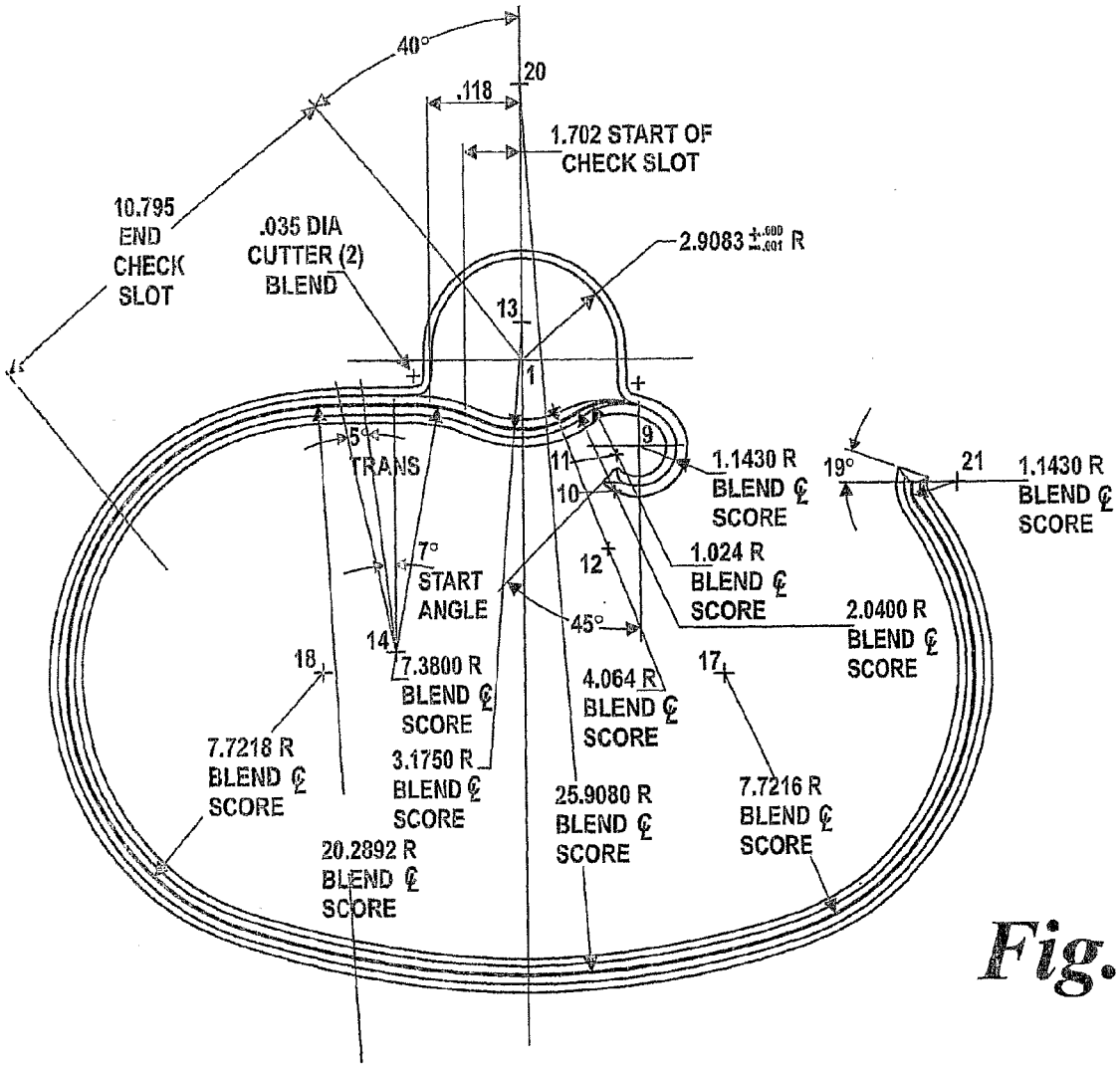
FIG. 2 illustrates a score panel of the type falling within the invention.

Turning to FIG. 2 the shape of the score panel 15, and hence the opening that it provides is defined by the score line 14*a*. The score line has three major portions, which the industry would define as occurring in the three o'clock, six o'clock and nine o'clock regions of the score, with the twelve o'clock position being aligned with the centre point of the tab rivet 17.

In the FIG. 2 arrangement each of the three o'clock, six o'clock and nine o'clock portions are formed by parts of respective notional circles. Thus the three and nine o'clock regions are based on circles having radiuses of 7.7216 mm, in the specific embodiment, whilst the six o'clock region a notional circle having a radius of 25.9080 mm. It will be noted that these dimensions provide for smooth transitions between the portions of the score line.

It is believed that the preferred range for the diameter for the three and nine o'clock regions is between 7.6 mm and 7.75 mm, whilst for the six o'clock region the preferred range is between 20 mm and 30 mm.

The width of the hinge 17 should preferably be between 6.5 mm and 7.6 mm.

The lines that are broken in the informal drawing are in reality smooth curves or straight lines.

For the purposes of this specification the minor axis runs between the twelve o'clock and six o'clock positions whilst the major axis runs between the three o'clock and nine o'clock positions.

The area of opening formed when the score panel 15 is opened is 381.5 $mm^2$ for the illustrated embodiment and preferably should be in the range 350 $mm^2$-400 $mm^2$.

The invention claimed is:

1. A can end (10) comprising: an end panel (12) with a diameter less than 47 mm, an openable non-removable panel (15) defined by a score line (14) in the end panel (12) and a non-removable tab (13) attached to the end for acting on the openable panel (15) to cause it to pivot out of the plane of the end panel (12) to provide an opening, the opening being generally oblate with its minor axis passing through the tab wherein a ratio of a dimension of the opening on a major axis to a dimension of the opening on a minor axis is greater than 1.7 and an opening area is greater than 350 $mm^2$ and the opening is generally symmetrical about the minor axis.

2. The can end of claim 1 wherein the ratio is between 1.7 and 1.8.

3. The can end of claim 1 wherein the score line (14) does not extend a whole way around the opening, and thus defines a hinge (17) in the end panel (12), wherein the hinge is between 6.5 mm and 7.6 mm in width.

4. The can end of claim 1 wherein a portion of the score line (14) that passes through the minor axis and is spaced from the tab (13) forms part of a notional circle having a radius of between 20 mm and 30 mm.

5. The can end of claim 1 wherein portions of the score line (14) that pass through the major axis form part of respective notional circles having radiuses of between 7.6 mm and 7.75 mm.

6. The can end as claimed in claim 5 wherein the portions of the score line (14) that pass through the major axis are dimensioned to provide smooth transitions between them.

7. The can end of claim 2 wherein the score line (14) does not extend an entire way around the opening, and thus defines a hinge (17) in the end panel (12), wherein the hinge is between 6.5 mm and 7.6 mm in width.

8. The can end of claim 2 wherein a portion of the score line (14) that passes through the minor axis and is spaced from the tab (13) forms part of a notional circle having a radius of between 20 mm and 30 mm.

9. The can end of claim 3 wherein a portion of the score line (14) that passes through the minor axis and is spaced from the tab (13) forms part of a notional circle having a radius of between 20 mm and 30 mm.

10. The can end of claim 2 wherein portions of the score line (14) that pass through the major axis from part of respective notional circles having radiuses of between 7.6 mm and 7.75 mm.

11. The can end of claim 3 wherein portions of the score line (14) that pass through the major axis from part of respective notional circles having radiuses of between 7.6 mm and 7.75 mm.

12. The can end of claim 4 wherein portions of the score line (14) that pass through the major axis from part of respective notional circles having radiuses of between 7.6 mm and 7.75 mm.

13. The can end of claim 10 wherein the portions of the score line (14) that pass through the major axis are dimensioned to provide smooth transitions between them.

14. The can end of claim 11 wherein the portions of the score line (14) that pass through the major axis are dimensioned to provide smooth transitions between them.

15. The can end of claim 12 wherein the portions of the score line (14) that pass through the major axis are dimensioned to provide smooth transitions between them.

* * * * *